US012129140B2

(12) United States Patent
Matsumoto

(10) Patent No.: US 12,129,140 B2
(45) Date of Patent: Oct. 29, 2024

(54) SHEET FEEDING APPARATUS AND IMAGE FORMING APPARATUS

(71) Applicant: CANON KABUSHIKI KAISHA, Tokyo (JP)

(72) Inventor: Yasuaki Matsumoto, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 18/222,619

(22) Filed: Jul. 17, 2023

(65) Prior Publication Data

US 2023/0356967 A1 Nov. 9, 2023

Related U.S. Application Data

(60) Division of application No. 17/940,263, filed on Sep. 8, 2022, now abandoned, which is a continuation of (Continued)

(30) Foreign Application Priority Data

Aug. 26, 2019 (JP) ..... 2019-154160

(51) Int. Cl.
*B65H 3/06* (2006.01)
*B65H 1/08* (2006.01)

(52) U.S. Cl.
CPC ..... *B65H 3/0669* (2013.01); *B65H 1/08* (2013.01); *B65H 3/0607* (2013.01); *B65H 3/0684* (2013.01)

(58) Field of Classification Search
CPC ..... B65H 3/0669; B65H 1/08; B65H 3/0607; B65H 3/0684
See application file for complete search history.

(56) References Cited

U.S. PATENT DOCUMENTS 8,152,159 B2 4/2012 Okumura
8,430,393 B2 * 4/2013 Matsushima ..... B65H 3/0669 271/10.09

(Continued)

FOREIGN PATENT DOCUMENTS

JP 2010-64805 A 3/2010
JP 2016-108067 A 6/2016

(Continued)

OTHER PUBLICATIONS

Japanese Office Action dated May 23, 2023, in related Japanese Patent Application No. 2019-154160.

*Primary Examiner* — Thomas A Morrison
(74) *Attorney, Agent, or Firm* — VENABLE LLP

(57) ABSTRACT

A sheet feeding apparatus includes a sheet support to support a sheet, a sheet feeder to contact an upper surface of the sheet supported on the sheet support and feed the sheet, and a conveyor to convey the sheet fed from the sheet feeder. A first motor drives the sheet feeder and the conveyor, a second motor rotates in a first direction and in a second direction opposite to the first direction, and a lift is connected to the second motor and lifts the sheet feeder in a case where the second motor rotates in the second direction. A controller controls the first motor and the second motor and, during a job of feeding a sheet from the sheet support, starts rotation of the second motor in the second direction after starting feeding of a final sheet in the job and before stopping the first motor.

10 Claims, 12 Drawing Sheets

Related U.S. Application Data application No. 16/936,672, filed on Jul. 23, 2020, now Pat. No. 11,479,423.

(56) References Cited

U.S. PATENT DOCUMENTS

| | | | | |
|---|---|---|---|---|
| 8,727,339 | B2 | 5/2014 | Matsushima et al. | |
| 8,939,446 | B2 * | 1/2015 | Ichikawa | B65H 3/0676 271/117 |
| 9,771,226 | B2 | 9/2017 | Zensai | |
| 10,394,179 | B1 | 8/2019 | Fujinuma | |
| 2010/0059929 | A1 | 3/2010 | Okumura | |
| 2011/0180985 | A1 | 7/2011 | Yamamoto | |
| 2013/0221604 | A1 | 8/2013 | Matsushima et al. | |
| 2015/0151935 | A1 | 6/2015 | Murakami et al. | |
| 2016/0159590 | A1 * | 6/2016 | Zensai | B65H 1/14 271/118 |
| 2016/0355355 | A1 | 12/2016 | Hirajima | |
| 2017/0152116 | A1 | 6/2017 | Hashimoto | |
| 2018/0222699 | A1 * | 8/2018 | Yoshida | B65H 1/266 |
| 2019/0256308 | A1 | 8/2019 | Yamashita | |
| 2019/0300307 | A1 | 10/2019 | Ohno | |

FOREIGN PATENT DOCUMENTS

| | | | |
|---|---|---|---|
| JP | 2017-132578 | A | 8/2017 |
| JP | 2018-24513 | A | 2/2018 |
| JP | 2018-127312 | A | 8/2018 |
| JP | 2018-135171 | A | 8/2018 |
| JP | 2018-188255 | A | 11/2018 |
| JP | 2019-14581 | A | 1/2019 |
| WO | 2011/007406 | A1 | 1/2011 |

* cited by examiner

SHEET FEEDING APPARATUS AND IMAGE FORMING APPARATUS

This application is a divisional of application Ser. No. 17/940,263, filed Sep. 8, 2022, which is a continuation of application Ser. No. 16/936,672, filed Jul. 23, 2020, now U.S. Pat. No. 11,479,423, issued Oct. 25, 2022.

BACKGROUND OF THE INVENTION

Field of the Invention

The present invention relates to a sheet feeding apparatus for feeding sheets and an image forming apparatus for forming an image on a sheet.

Description of the Related Art

Image forming apparatuses such as printers, copying machines and multifunctional devices include a sheet feeding apparatus that feeds sheets serving as recording materials or original documents one at a time from a pile of sheets stacked on a tray using a feeding member such as a feed roller or a pickup roller for feeding sheets. In such a sheet feeding apparatus, if the feed roller is in contact with the sheet for a long time, the oil contained in a rubber material forming an outer circumferential portion of the roller may ooze out onto the sheet, which may cause image defects in the subsequent printing operation.

Japanese Patent Application Laid-Open Publication No. 2018-24513 discloses a document feeding apparatus including a pickup roller that sends out paper while a motor rotates in a normal direction and the pickup roller is separated from the paper while the motor rotates in a reverse direction. According to a sheet feeding apparatus disclosed in Japanese Patent Application Laid-Open Publication No. 2010-64805, when a sheet feed cassette is attached to an apparatus body, a motor rotates in a normal direction to have a sheet bundle placed on a lift plate contact a pickup roller, and when the sheet feeding operation is ended, the motor rotates in a reverse direction to separate the sheet bundle from the pickup roller.

In the configurations disclosed in the above documents, it was necessary to rotate the motor in the reverse direction with sufficient drive amount to separate the pickup roller from the paper. However, various drawbacks occur as the time for driving the motor in the reverse direction extends, such as the elongation of period of generation of operation noise or reduction of life of the motor.

SUMMARY OF THE INVENTION

The present invention provides a sheet feeding apparatus and an image forming apparatus that can shorten a time required for separating a feeding member from a sheet.

According to one aspect of the invention, a sheet feeding apparatus includes a sheet supporting portion configured to support a sheet, a feeding member configured to contact an upper surface of the sheet supported on the sheet supporting portion and feed the sheet, a drive motor configured to rotate in a first direction and in a second direction opposite to the first direction, and a lifting mechanism connected to the drive motor and configured to lift the sheet supporting portion and lower the feeding member in a case where the drive motor rotates in the first direction, and to lower the sheet supporting portion and lift the feeding member in a case where the drive motor rotates in the second direction.

Further features of the present invention will become apparent from the following description of exemplary embodiments with reference to the attached drawings.

DESCRIPTION OF THE EMBODIMENTS

Now, exemplary embodiments of the present invention will be described in detail with reference to the drawings.

First Embodiment

Figure 1:
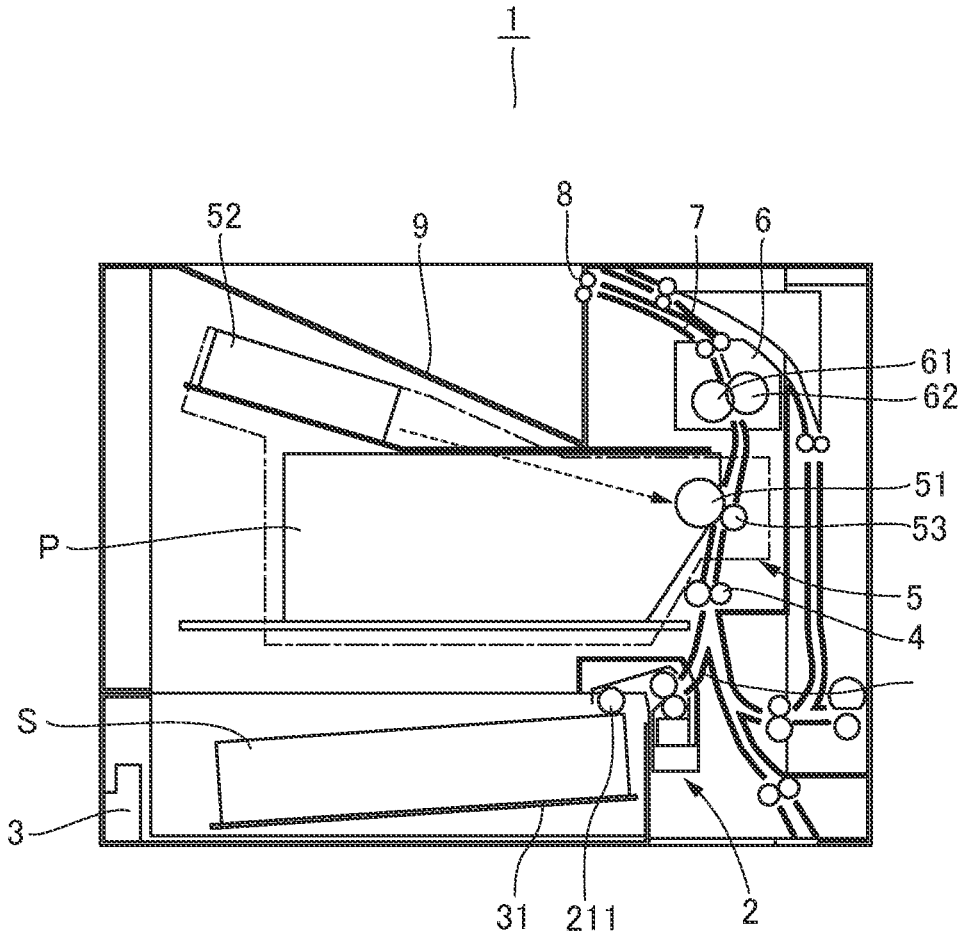
FIG. 1 is a schematic drawing of an image forming apparatus according to a first embodiment.

FIG. 1 is a schematic drawing illustrating an image forming apparatus 1 according to a first embodiment. The image forming apparatus 1 is a laser beam printer adopting an electrophotographic system that forms monochromatic toner images. The image forming apparatus 1 includes a sheet feeder 2 for feeding sheets serving as recording materials, and an image forming unit 5 that forms images on sheets. Recording materials can be plain paper, thick paper, plastic films, cloth, sheet materials subjected to surface treatment such as coated paper, special-shaped sheet material such as envelopes and index paper, and various other sheets having different sizes and materials.

The image forming unit 5 includes a processing cartridge P, a laser scanner 52 and a transfer roller 53. When an image forming command is entered to the image forming apparatus 1, the image forming unit 5 starts an image forming operation by an electrophotographic process. That is, a photosensitive drum 51 provided in the processing cartridge P starts to rotate, and a charging unit charges a surface of the drum uniformly. The laser scanner 52 irradiates the photosensitive drum 51 with a laser beam and exposes the photosensitive drum 51 based on image information entered to the image forming apparatus 1, to draw an electrostatic latent image on the drum surface. The latent image is developed using developer supplied from a developer container to form a toner image on the photosensitive drum 51.

In parallel with this process, a sheet S is fed from the sheet feeder 2. The sheet feeder 2 includes a feed roller 211 that feeds the sheet S supported on a lift plate 31 of a cassette 3 that can be drawn out of a casing of the image forming apparatus 1. The sheet S fed by the sheet feeder 2 is conveyed via a conveyance roller pair 4 to a transfer portion which is a nip portion between the photosensitive drum 51 and the transfer roller 53. In the transfer portion, a bias voltage having an opposite polarity as normal charge polarity of toner is applied to the transfer roller 53, by which the toner image borne on the photosensitive drum 51 is transferred to the sheet S.

A fixing unit 6 forms a fixing nip by a heating unit 61, which is composed of a fixing film and a ceramic heater serving as a heating element arranged on an inner circumferential side of the fixing film, and a pressure roller 62 in pressure contact with the heating unit 61. While the sheet S passes through the fixing nip, the toner image on the sheet is heated and pressed, by which toner is melted and fixed to have the unfixed image permanently fixed to the sheet S. The sheet S having passed through the fixing unit 6 is discharged via a sheet discharge path 7 to an exterior of the device by a sheet discharge roller pair 8 and stacked on a sheet discharge tray 9.

The present embodiment uses the image forming unit 5 serving as a direct transfer-type electrophotographic unit as the image forming unit for forming images on sheets. However, an intermediate transfer-type electrophotographic unit for transferring a toner image formed on a photosensitive member via an intermediate transfer body such as an intermediate transfer belt to a sheet can also be used as the image forming unit. Further, an inkjet-type image forming unit for forming an image on a sheet by discharging ink through nozzles can also be used as the image forming unit, for example.

Sheet Feeder

Figure 2:
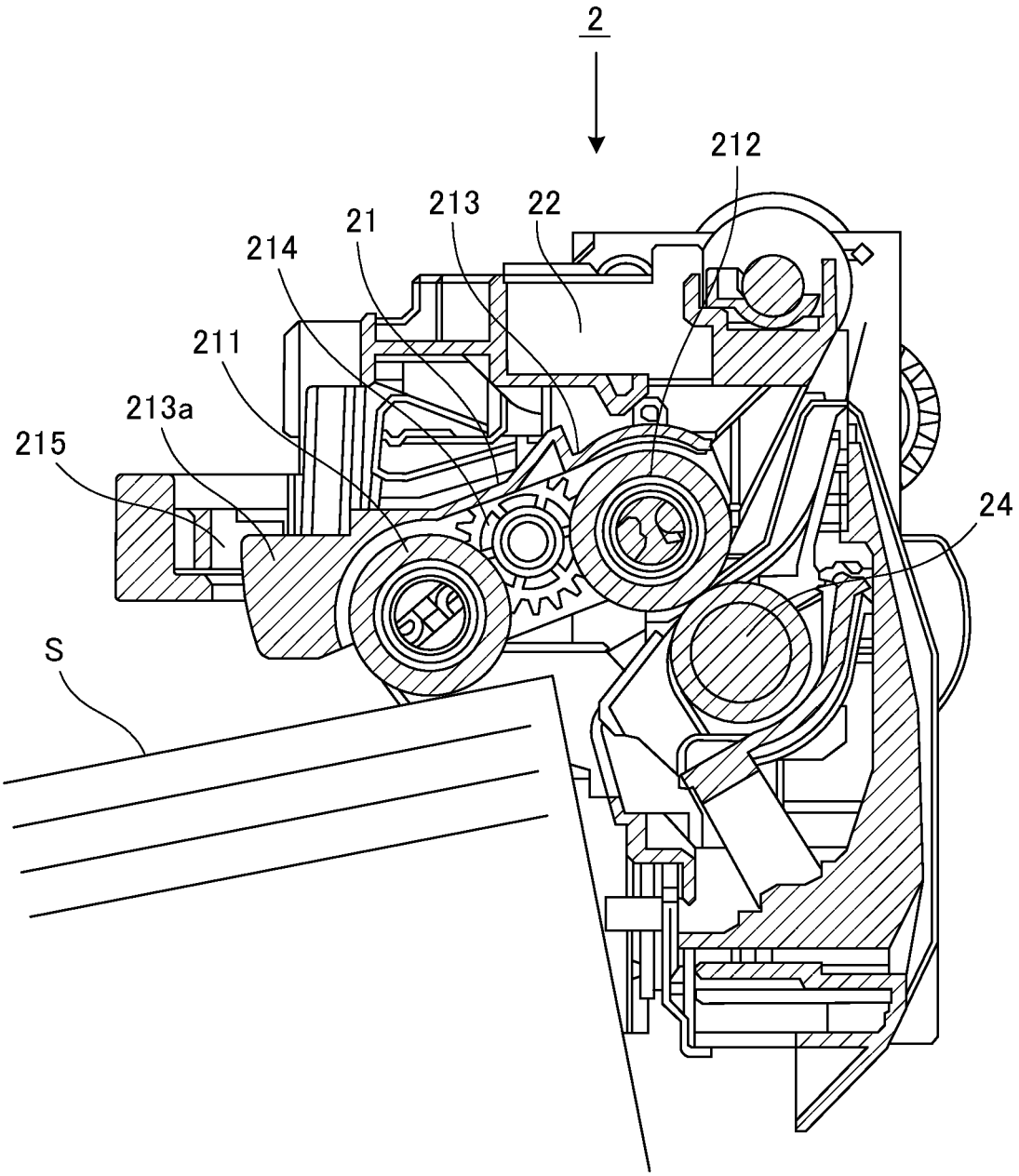
FIG. 2 is a cross-sectional view of a sheet feed unit according to the first embodiment.

A detailed configuration of the sheet feeder 2 serving as a sheet feeding apparatus according to the present embodiment will be described with reference to FIG. 2. FIG. 2 is a cross-sectional view of the sheet feeder 2 viewed in a width direction, that is, a direction orthogonal to a feeding direction, of the sheet fed by the sheet feeder 2.

Figure 8:
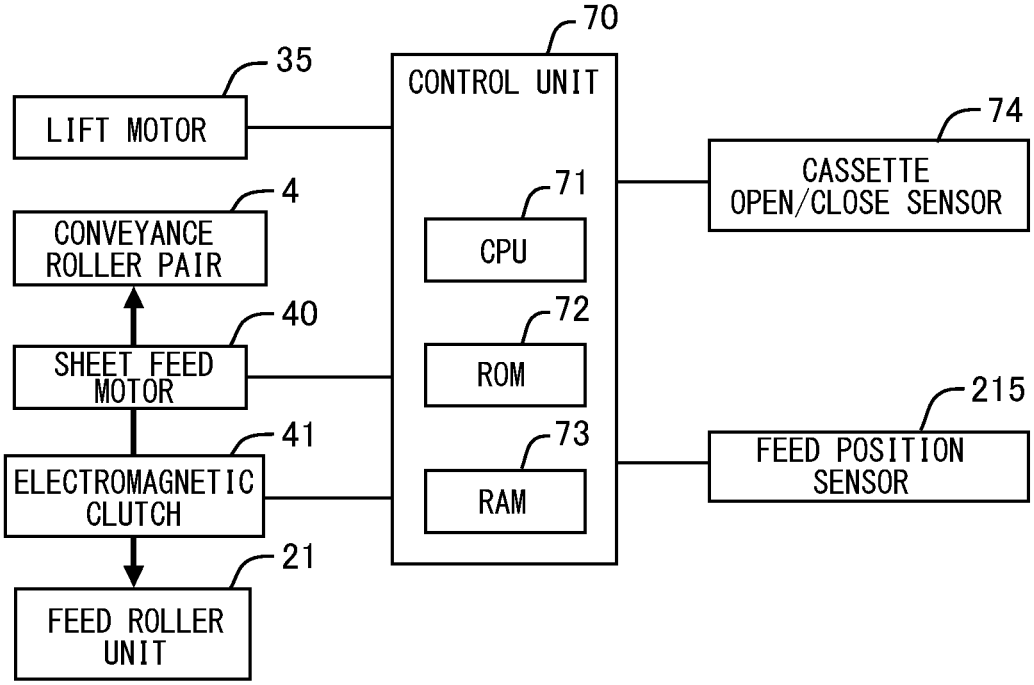
FIG. 8 is a block diagram illustrating a control configuration of the image forming apparatus according to the first embodiment.

The sheet feeder 2 includes a feeding frame 22, a feed roller unit 21 and a separation roller 24. The feeding frame 22 is fixed to a frame member of the image forming apparatus and constitutes a frame member of the sheet feeding apparatus according to the present embodiment. The feed roller unit 21 and the separation roller 24 are supported on the feeding frame 22. The cassette 3 is a sheet storage portion of the present embodiment for storing sheets and can be opened and closed with respect to a body of the image forming apparatus, in other words, can be moved with respect to the feeding frame 22, wherein opening and closing of the cassette is configured to be detected by a cassette open/close sensor 74 (FIG. 8).

The feed roller unit 21 is a unit including the feed roller 211, a conveyance roller 212, a roller holder 213 and an idler gear 214. The feed roller 211 and the conveyance roller 212 are held rotatably by the roller holder 213 serving as a retaining member. The roller holder 213 is capable of swinging about a rotational axis of the conveyance roller 212. A pressurization mechanism such as a spring member is connected to roller holder 213 to urge the feed roller 211 downward so as to apply pressurization force to the feed roller 211 against the sheet.

The feed roller 211 serving as a feeding member is driven by a sheet feed motor serving as a driving source described later to rotate in a counterclockwise direction in FIG. 2, and feeds the sheet supported on the lift plate 31 serving as a sheet supporting portion toward the feeding direction, corresponding to the right side of FIG. 2. The conveyance roller 212 is also driven by the sheet feed motor which serves as a common driving source, to rotate in the counterclockwise direction in FIG. 2 and further convey the sheet downstream in the feeding direction.

The separation roller 24 serving as a separation member is a roller member connected via a torque limiter to a shaft fixed to the feeding frame 22. The separation roller 24 contacts the conveyance roller 212 and forms a separation nip therewith, separating the sheet passing through the separation nip by frictional force. That is, if only one sheet sent out by the feed roller 211 passes through the separation nip, the torque limiter slips so that the separation roller 24 corotates with the conveyance roller 212 via the sheet. Meanwhile, if multiple sheets enter the separation nip, the separation roller 24 stops rotating so that the sheets are slid against one another, and only the uppermost sheet in contact with the conveyance roller 212 is conveyed. Such a separation roller 24 is an example of a separation member, and other members, such as a retard roller to which driving force in an opposite direction to the sheet feeding direction, i.e., counterclockwise direction in FIG. 2, is entered from a sheet feed motor, or a pad-shaped friction member in contact with the conveyance roller 212, can be used.

A feed position sensor 215, whose detection signal changes according to whether an upper surface of the sheet (i.e., upper surface of the uppermost sheet) placed on the lift plate 31 is at an appropriate height for feeding sheets by the feed roller 211, is provided on the sheet feeder 2. The appropriate height is hereinafter referred to as feeding position. The feed position sensor 215 is a detection member for detecting the position of the roller holder 213, and in the present embodiment, a photo-interrupter to be shielded of light by a detection portion 213*a*, serving as a light shielding portion, provided on the roller holder 213 is used. If the detection portion 213*a* is positioned on an optical axis of the feed position sensor 215, it is determined that the upper surface of the sheet supported on the lift plate 31 is positioned at the feeding position, and if not, it is determined that the upper surface of the sheet is positioned either above or below the feeding position.

As described, in a case where the sheet feeder 2 starts a sheet feeding operation, the feed roller 211 lowers from an upper position positioned above the feeding position and moves temporarily to a lower position positioned below the feeding position. In this state, when the upper surface of the sheet contacts the feed roller 211 by the lift plate 31 being lifted, the roller holder 213 is lifted against the urging force of the pressurization mechanism. Then, when the feed position sensor 215 detects the detection portion 213*a*, lifting of the lift plate 31 is stopped. If the lift plate 31 is lifted in a state where no sheets are placed on the lift plate 31, the lift plate itself will be in contact with the feed roller 211.

In a state where the feed roller 211 is in contact with the sheet at the feeding position, the sheet feed motor rotates the feed roller 211 and the conveyance roller 212, by which the sheets are sent out from the cassette 3. Then, the sheets are separated one sheet at a time by the conveyance roller 212 and the separation roller 24 and conveyed to the conveyance roller pair 4. By repeating the feeding of sheets, the number of sheets stacked on the lift plate 31 will reduce, and along therewith, the position of the feed roller 211 is gradually lowered. If the detection portion 213*a* of the roller holder 213 moves to a position where it cannot be detected by the feed position sensor 215, a lift motor 35 lifts the lift plate 31 again until the feed position sensor 215 detects the detection portion 213*a*. Thereby, the upper surface of the sheets stacked on the lift plate 31 will constantly be controlled to fall within a fixed range.

Lifting and Lowering of Lift Plate

Figure 3A:
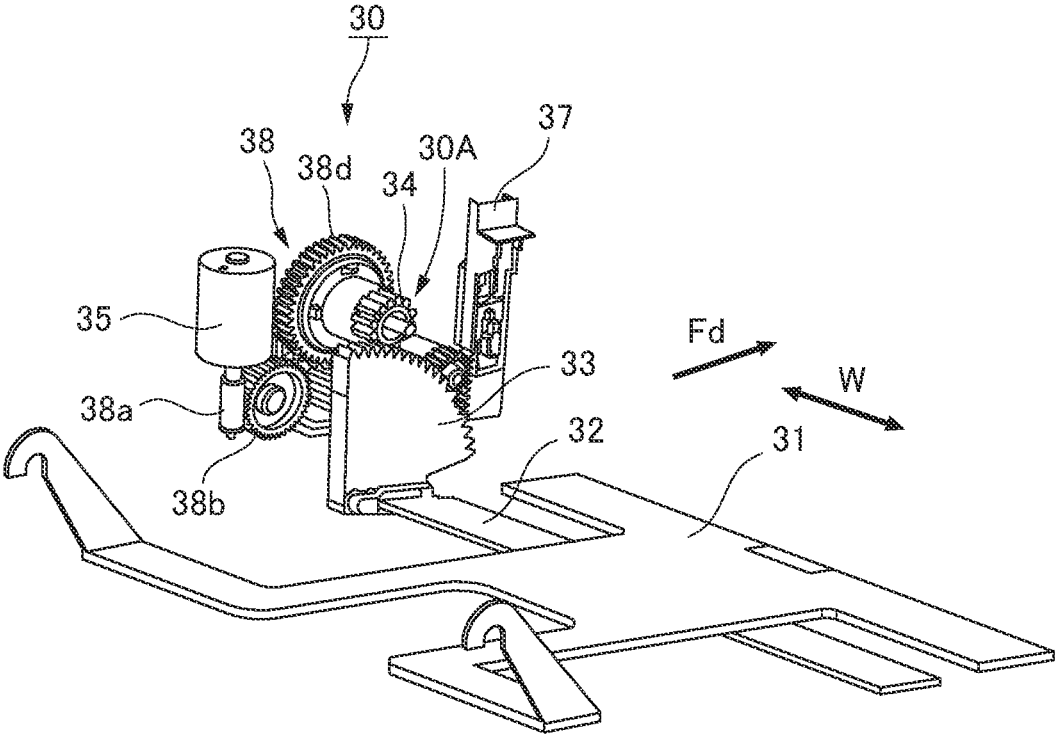
FIG. 3A is a perspective view illustrating a lift plate and a lifting mechanism thereof according to the first embodiment.
Figure 3B:
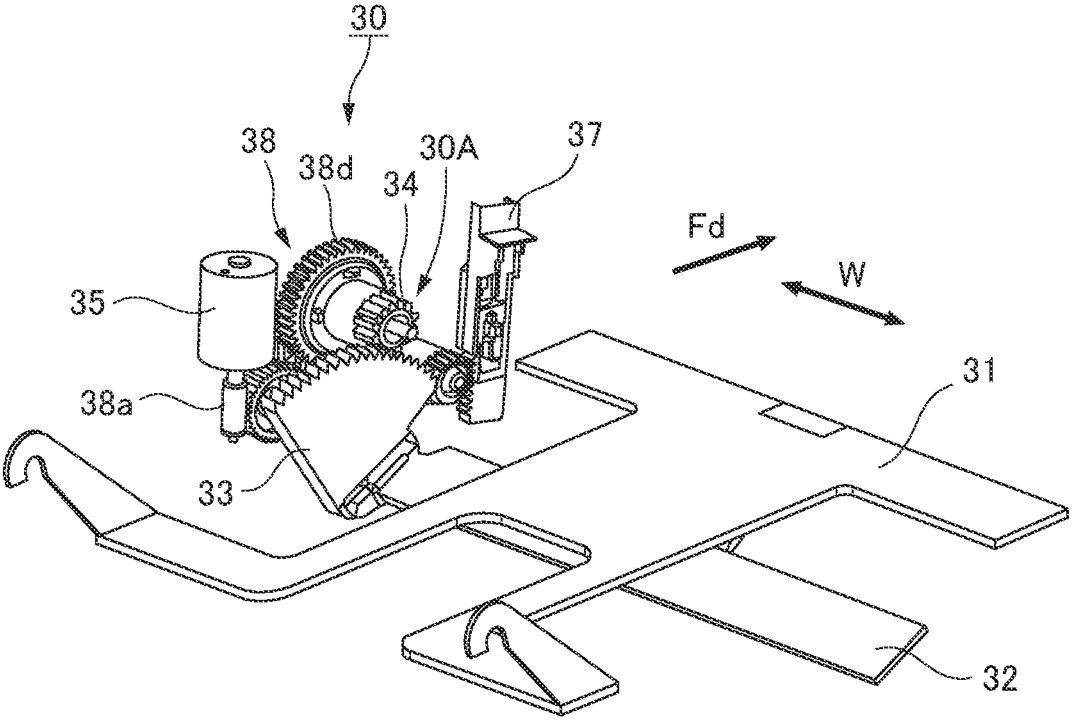
FIG. 3B is a perspective view illustrating the lift plate and the lifting mechanism thereof according to the first embodiment.

Next, a lifting mechanism provided on the cassette 3 will be described with reference to FIGS. 3A and 3B. FIGS. 3A and 3B are perspective views illustrating a general configuration of a lifting mechanism 30 according to the present embodiment. FIG. 3A illustrates an initial state where the lift plate 31 is at an initial position, and FIG. 3B illustrates a lift-up state where the lift plate 31 is positioned upward of the initial position.

As illustrated in FIG. 3A, the lifting mechanism 30 includes a lift member 32, a lift input gear 34 and a lift output gear 33. The lift member 32 is arranged between a bottom portion of the cassette 3 and the lift plate 31, supported pivotably by the cassette 3 and lifts or lowers the lift plate 31 by pivoting. The lift output gear 33 is a sector gear that pivots integrally with the lift member 32 and that is meshed with the lift input gear 34. The lift input gear 34 is coupled to a lift motor 35 serving as a driving source via a reduction gear train 38 and rotates by driving force of the lift motor 35.

In the lifting mechanism 30, the reduction gear train 38 constitutes a transmission portion that also transmits the driving force of the lift motor 35 to a roller lifting portion 30B described later. The lift output gear 33, the lift input gear 34 and the lift member 32 operate by receiving the driving force from the transmission portion, and they constitute a lift plate lifting portion 30A, serving as a first lifting portion according to the present embodiment, for lifting the lift plate 31.

The lift motor 35 is a drive motor that rotates in a first direction and in a second direction opposite to the first direction based on a command signal from a control unit 70 described later. Hereafter, the direction of rotation of the lift motor 35 for lifting the lift member 32 to lift the lift plate 31 up, that is, first direction in the present embodiment, is referred to as a "normal direction". In contrast, the direction of rotation of the lift motor 35 for lowering the lift member 32 and lowering the lift plate 31, that is, second direction in the present embodiment, is referred to as a "reverse direction".

The lift member 32 and the lift output gear 33 are supported on the cassette 3, and the lift input gear 34 and the reduction gear train 38 are supported on the frame member of the image forming apparatus together with the lift motor 35. Therefore, if the cassette 3 is drawn out in a width direction W, that is, a direction perpendicular to a feeding direction Fd, of the sheet in FIGS. 3A and 3B, meshing of the lift output gear 33 and the lift input gear 34 is disengaged. If the cassette 3 is inserted to a predetermined attachment position illustrated in FIGS. 3A and 3B with respect to the image forming apparatus, the lift output gear 33 and the lift input gear 34 are meshed, and the lift member 32 will be in a state constantly coupled to the lift motor 35. Therefore, according to the present embodiment, in a state where the cassette 3 is closed, the lift motor 35 is capable of both lifting and lowering the lift plate 31.

The reduction gear train 38 includes a worm gear 38*a* and a plurality of step gears 38*b* and 38*c* (refer also to FIG. 4), and the reduction gear train 38 decelerates rotation of the lift motor 35 and transmits the rotation to a large-diameter gear 38*d* formed integrally with the lift input gear 34. Therefore, even if a small motor having a relatively small output torque is used as the lift motor 35, lifting and lowering operation of the lift plate 31, and also that of the feed roller 211 described later, can be performed stably.

Lifting Mechanism of Feed Roller

Figure 4:
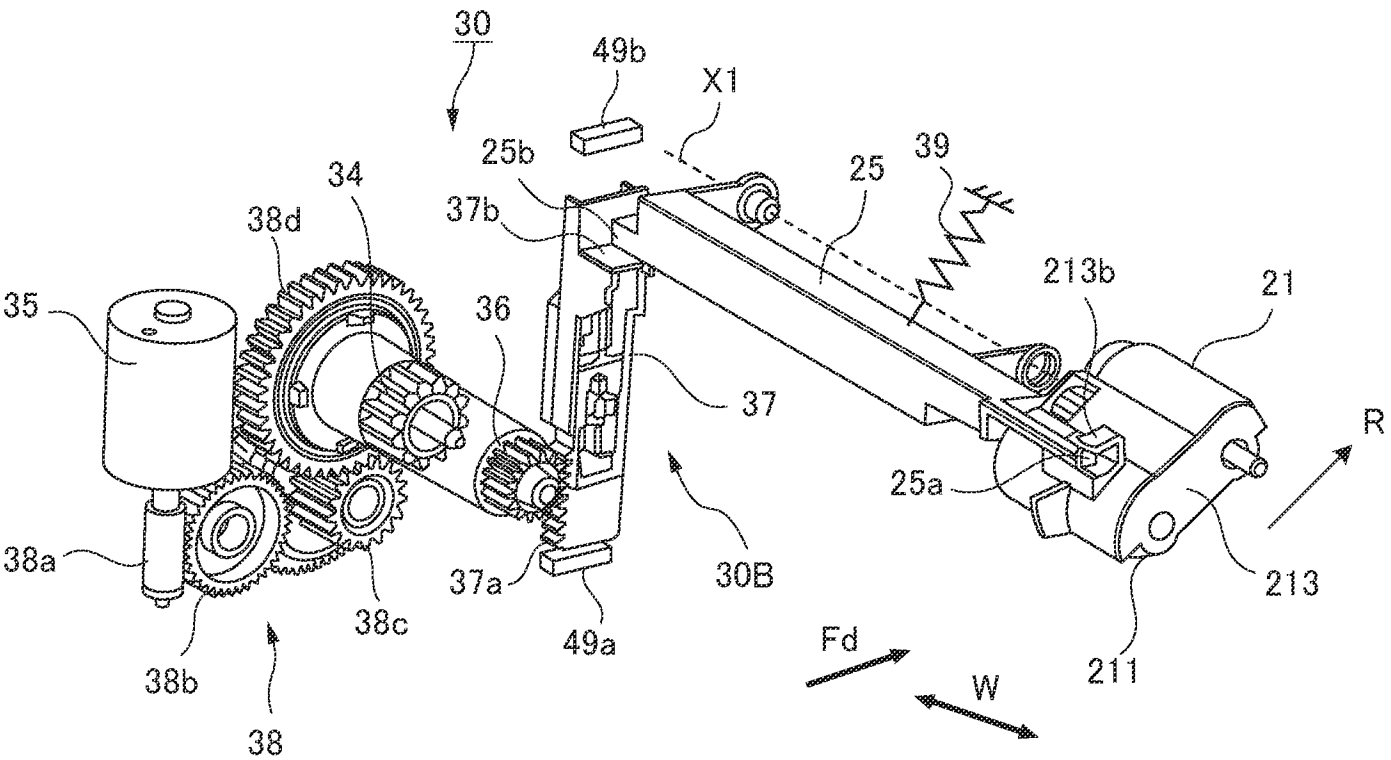
FIG. 4 is a perspective view illustrating a lifting mechanism of a feed roller according to the first embodiment.

Next, the roller lifting portion 30B, serving as a second lifting portion according to the present embodiment, which is a mechanism for lifting and lowering the feed roller 211 using the driving force of the lift motor 35 will be described with reference to FIG. 4. The roller lifting portion 30B is provided between the lift motor 35 and the feed roller unit 21 in a manner coupling the reduction gear train 38 serving as a transmission portion and the roller holder 213. The roller lifting portion 30B is an apparatus, i.e., feed roller contact-separation portion, that uses the driving force of the lift motor 35 to swing the roller holder 213 to thereby cause the feed roller 211 to contact or separate from the sheet.

The roller lifting portion 30B is composed of a roller lifting gear 36, a roller lifting link 37 and a roller lifting lever 25. The roller lifting gear 36 is coupled to the lift motor 35 via the reduction gear train 38. The roller lifting lever 25 is a swing member that is coupled to the feed roller unit 21 and that swings in linkage with the feed roller unit 21. The roller lifting link 37 is a link member that includes a rack portion 37*a* meshed with the roller lifting gear 36 and that couples the roller lifting gear 36 with the roller lifting lever 25.

The roller lifting link 37 and the roller lifting lever 25 are supported movably by the feeding frame 22. The roller lifting link 37 is capable of moving in sliding motion upward and downward, that is, approximately in the vertical direction (i.e., the gravity direction), and converting the rotation of the roller lifting gear 36 meshed with the rack portion 37*a* to linear motion in the upward and downward directions. The roller lifting link 37 is lowered by rotation of the lift motor 35 in the normal direction, and the roller lifting link 37 is lifted by the rotation of the lift motor 35 in the reverse direction.

The roller lifting lever 25 is a swing member capable of swinging up and down about a swing axis X1 that extends in a rotational axis direction, that is, sheet width direction, of the feed roller 211. The roller lifting lever 25 is engaged with the roller holder 213 of the feed roller unit 21 at one end portion 25*a* in the axial direction and swings up and down with the roller holder 213. The other end portion 25*b* in the axial direction of the roller lifting lever 25 opposes to a pressing portion 37*b* provided on an upper end of the roller lifting link 37. An engagement portion between the pressing portion 37*b* and the end portion 25*b* of the roller lifting lever 25 is configured to allow, when the feed roller 211 is pressed by the sheet, the roller holder 213 and the roller lifting lever 25 to swing upward in a state where the roller lifting link 37 is stopped. Further, a pressurizing spring 39 serving as an urging member is attached between the roller lifting lever 25 and the feeding frame 22, by which the roller lifting lever 25 is urged downward. In FIG. 4, the pressurizing spring 39 is illustrated as a torsion coil spring, but the configuration of the urging member is not limited thereto, and for example, a torsion coil spring mounted around the swing axis X1 may also be used.

In a case where the roller lifting link 37 is lowered by rotation of the lift motor 35 in the normal direction, the roller lifting lever 25 pivots downward by an action of urging force of the pressurizing spring 39 and the own weight of the roller lifting lever 25. In a case where the roller lifting link 37 is lifted by rotation of the lift motor 35 in the reverse direction, the roller lifting lever 25 is pressed by the pressing portion 37*b* of the roller lifting link 37 and swings upward.

Further, the feed roller unit 21 is detachably attached to the feeding frame 22, and an engagement position, i.e., connecting portion, of the feed roller unit 21 and the roller lifting lever 25 is also detachable. The engagement position is configured so that the end portion 25*a* of the roller lifting lever 25 is fitted to a hook portion 213*b* provided on the roller holder 213.

The feed roller unit 21 can be removed from the feeding frame 22 toward a predetermined removing direction R that intersects the rotational axis of the feed roller 211, in other words, a direction that intersects the axial direction of the swing axis X1 of the roller lifting lever 25. In correspondence therewith, the hook portion 213*b* is formed in a recessed shape with the upstream side in the removing direction R recessed, and along with a removal operation of removing the feed roller unit 21, the end portion 25*a* of the roller lifting lever 25 is disengaged from the hook portion 213*b*. In a case where the feed roller unit 21 is attached to the feeding frame 22 toward a direction opposite to the removing direction R, the end portion 25*a* of the roller lifting lever 25 fits to the hook portion 213*b*, and the roller lifting lever 25 will be in a state swinging together with the roller holder 213.

As described later, drive amount of the lift motor 35 for driving the lift plate 31 in the operation of moving the feed roller 211 to be in contact with and separated from the sheet is normally greater than the drive amount of the lift motor 35 for lifting and lowering the feed roller 211. A torque limiter is assembled to the roller lifting gear 36, for example, as a mechanism for absorbing such difference of drive amount by shutting off drive transmission to the roller lifting lever 25 in the roller lifting portion 30B. Further, stoppers 49*a* and 49*b* for regulating range of movement of the roller lifting link 37 is fixed to the feeding frame 22 in the roller lifting portion 30B. The shape of the stopper 49*a* is not necessarily the illustrated shape, i.e., block shape, and for example, a hole capable of receiving a protruded shape formed on the roller lifting link 37 can be provided on a metal plate constituting the feeding frame as the stopper.

In a case where the lift motor 35 rotates in the normal direction, when the roller lifting link 37 is lowered to a position in contact with the stopper 49*a*, the torque limiter slips so that the roller lifting link 37 is not lowered further. The position of the roller lifting link 37 in this state corresponds to the lower limit of the lifting and lowering range of the feed roller 211. The lift motor 35 continues to rotate in the normal direction in a state where the roller lifting link 37 is in contact with the stopper 49*a*, by which the lift plate 31 is continued to be lifted. Similarly, in a case where the lift motor 35 rotates in the reverse direction, when the roller lifting link 37 is lifted to a position in contact with the stopper 49*b*, the torque limiter slips so that the roller lifting link 37 is not lifted further. The position of the roller lifting link 37 in this state corresponds to the upper limit of the lifting and lowering range of the feed roller 211. The lift motor 35 continues to rotate in the reverse direction in a state where the roller lifting link 37 is in contact with the stopper 49*b*, by which the lift plate 31 is continued to be lowered. In other words, the torque value of the torque limiter of the roller lifting gear 36 is set to a value high enough to swing the roller lifting lever 25 together with the roller holder 213 but low enough so that the roller lifting link 37 is stopped by the stoppers 49*a* and 49*b*.

An example has been illustrated of a case where a torque limiter is positioned between the lift motor 35 and the roller lifting link 37, but instead, a one-way gear may be arranged between the lift motor 35 and the roller lifting link 37. In that case, in a state where the lift motor 35 is stopped, the one-way gear is designed to be locked when the roller lifting link 37 is lowered and rotates idly when the roller lifting link 37 is lifted. In this case, if the lift motor 35 rotates in the reverse direction, the roller lifting link 37 is lifted in a state where the one-way gear is locked, and the feed roller 211 is thereby lifted. Meanwhile, if the lift motor 35 rotates in the normal direction, the roller lifting link 37 is allowed to be lowered by the action of the urging force of the pressurizing spring 39. When the roller lifting link 37 is lowered to the lower limit position, the lowering of the roller lifting link 37 is stopped and the one-way gear rotates idly. As described, in lifting the feed roller 211, the roller lifting link 37 is moved in a movement direction, i.e., upward in the present embodiment, for lifting the feed roller 211 by drive transmission via the one-way gear in the locked state, so that the feed roller 211 can be lifted more reliably. Meanwhile, in lowering the feed roller 211, the roller lifting link 37 moves in a movement direction, i.e., downward in the present embodiment, for lowering the feed roller 211 by the urging force of the pressurizing spring 39, so that the feed roller 211 can be in contact with the sheet with appropriate pressurizing force by adjusting the spring force of the pressurizing spring 39.

Operation of Lifting Mechanism

Figure 5A:
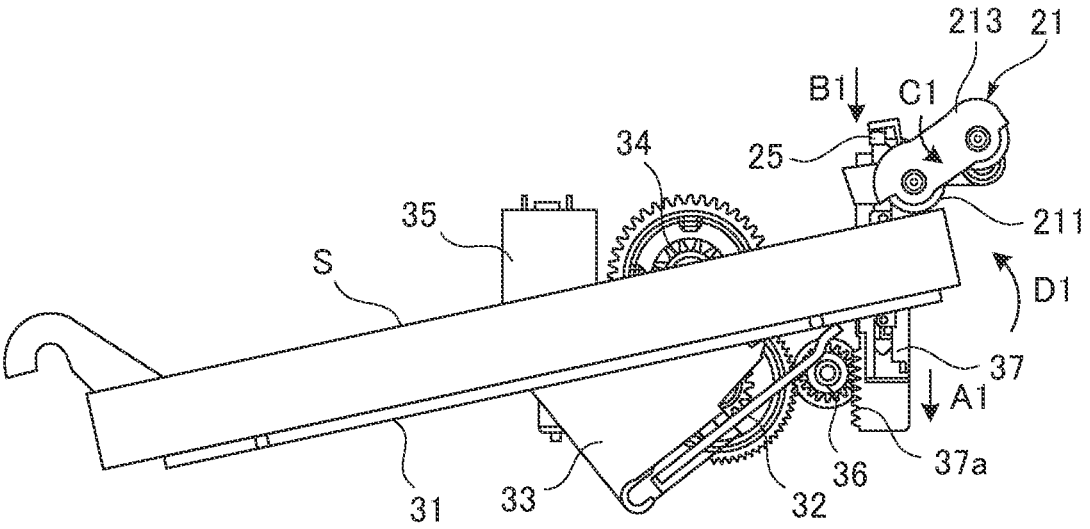
FIG. 5A is a view illustrating a lifting and lowering operation of the feed roller and the lift plate according to the first embodiment.
Figure 5B:
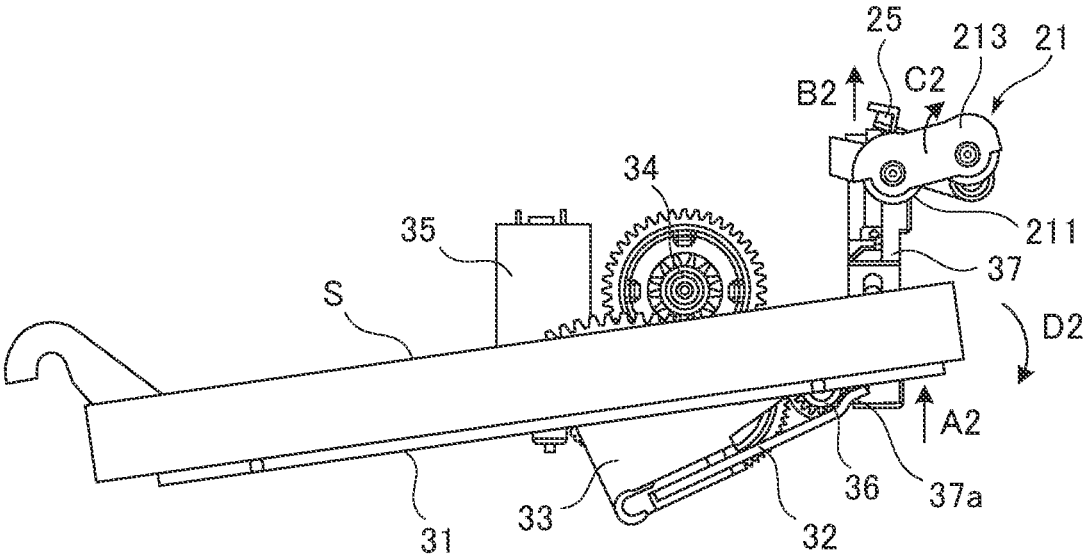
FIG. 5B is a view illustrating the lifting and lowering operation of the feed roller and the lift plate according to the first embodiment.
Figure 6A:
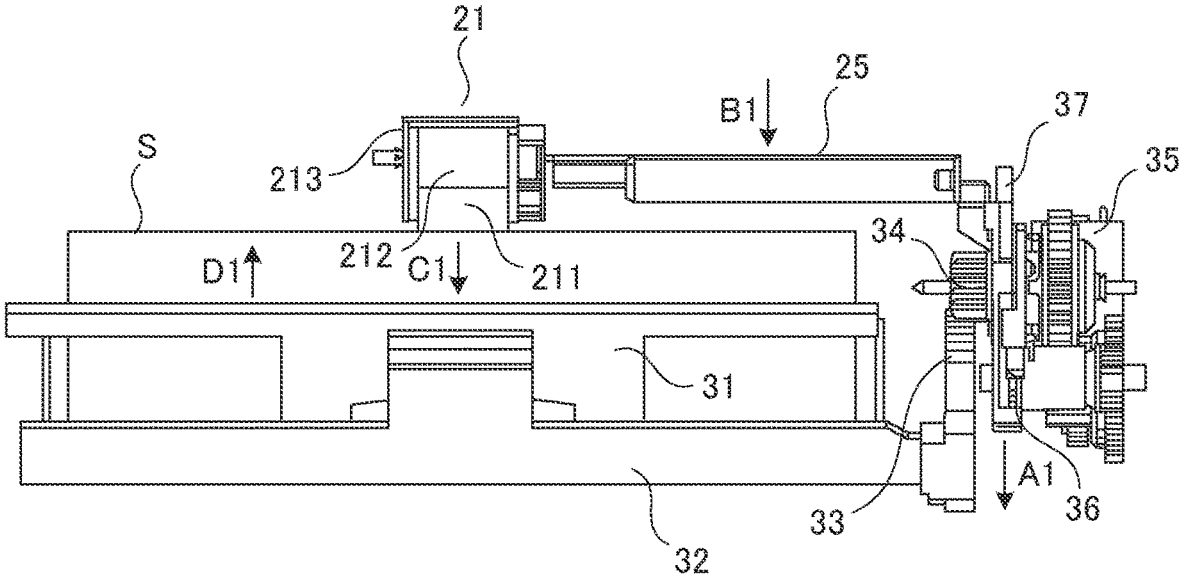
FIG. 6A is a view illustrating the lifting and lowering operation of the feed roller and the lift plate according to the first embodiment.

Next, a lifting and lowering operation of the lift plate 31 and the feed roller 211 by the lifting mechanism 30 according to the present embodiment will be described with reference to FIGS. 5A to 7D. FIG. 5A is a schematic drawing illustrating a state where the feed roller 211 is in contact with the sheet on the lift plate 31, hereinafter referred to as a feed-roller contact state, viewed in the rotational axis direction, i.e., sheet width direction, of the feed roller 211. FIG. 5B is a schematic drawing illustrating a state where the feed roller 211 is separated from the sheet on the lift plate 31, hereinafter referred to as a feed-roller separated state, viewed in the rotational axis direction of the feed roller 211. FIG. 6A is a schematic drawing illustrating the feed-roller contact state viewed from the downstream side of the feeding direction, and FIG. 6B is a schematic drawing illustrating the feed-roller separated state viewed from the downstream side of the feeding direction.

As illustrated in FIGS. 5A and 6A, the lift motor 35 rotates in the normal direction in an operation of transiting from the feed-roller separated state to the feed-roller contact state, that is, in a feed-roller contact operation. Thereby, the lifting mechanism 30 performs operation to lower the feed roller 211 by the roller lifting portion 30B and lift the lift plate 31 by the lift plate lifting portion 30A. That is, by the lift motor 35 rotating in the normal direction, the roller lifting link 37 is lowered (arrow A1), along with which the roller lifting lever 25 pivots downward (arrow B1), and the feed roller unit 21 pivots downward in linkage with the roller lifting lever 25 (arrow C1). In parallel therewith, the lift member 32 pivots upward by the lift motor 35 rotating in the normal direction, and the lift plate 31 is thereby lifted (arrow D1). As described earlier, in a case where the feed position sensor 215 detects the detection portion 213*a* of the roller holder 213, the lifting of the lift plate 31 is stopped and the feed-roller contact state is realized.

Figure 6B:
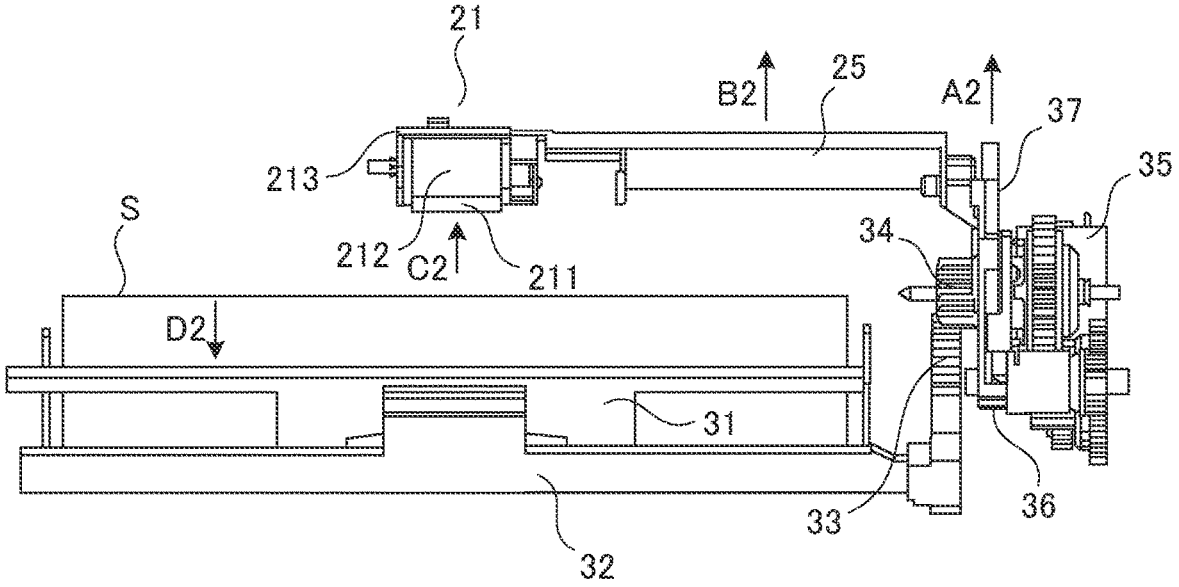
FIG. 6B is a view illustrating the lifting and lowering operation of the feed roller and the lift plate according to the first embodiment.

Meanwhile, as illustrated in FIGS. 5B and 6B, the lift motor 35 rotates in the reverse direction in an operation of transiting from the feed-roller contact state to the feed-roller separated state, that is, in a feed-roller separating operation. Thereby, the lifting mechanism 30 performs operation to lift the feed roller 211 by the roller lifting portion 30B and lower the lift plate 31 by the lift plate lifting portion 30A. That is, by the lift motor 35 rotating in the reverse direction, the roller lifting link 37 is lifted (arrow A2), along with which the roller lifting lever 25 pivots upward (arrow B2), and the feed roller unit 21 pivots upward in linkage with the roller lifting lever 25 (arrow C2). In parallel therewith, the lift member 32 pivots downward by the rotation of the lift motor 35 in the reverse direction and lowers the lifting plate 31 (arrow D2). Thereby, the feed-roller separated state is realized.

Figure 7A:
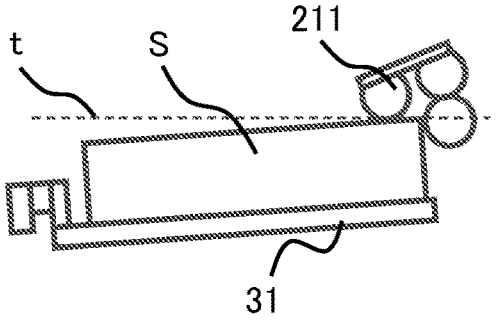
FIG. 7A is an explanatory view illustrating the lifting and lowering operation of the feed roller and the lift plate according to the first embodiment.
Figure 7B:
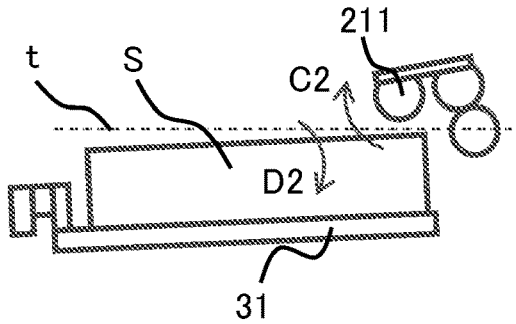
FIG. 7B is an explanatory view illustrating the lifting and lowering operation of the feed roller and the lift plate according to the first embodiment.
Figure 7C:
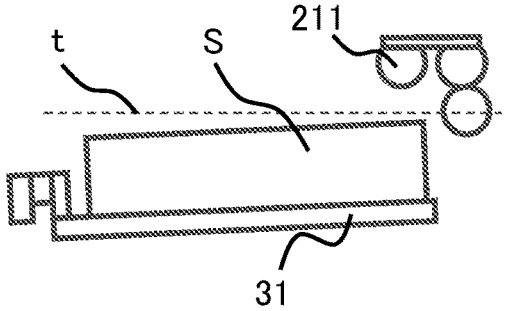
FIG. 7C is an explanatory view illustrating the lifting and lowering operation of the feed roller and the lift plate according to the first embodiment.
Figure 7D:
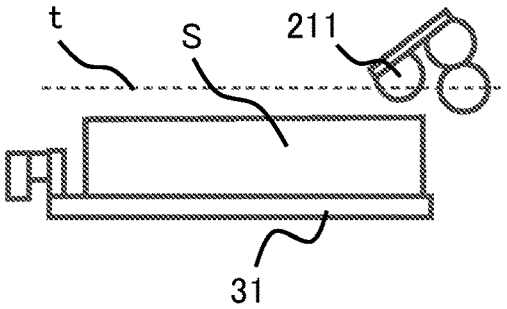
FIG. 7D is an explanatory view illustrating the lifting and lowering operation of the feed roller and the lift plate according to the first embodiment.

FIGS. 7A to 7D illustrate the process of the feed-roller separating operation in a simplified manner. FIG. 7A illustrates a feed-roller contact state, FIG. 7B illustrates a state in midway of separation operation, and FIG. 7C illustrates a state where the separation operation has been completed. FIG. 7D illustrates a state where only the lift plate 31 is lowered from the feed-roller contact state to the initial position, as a reference drawing. The dotted line t in FIGS. 7A to 7D illustrate an appropriate height position, that is, feeding position, in which the feed roller 211 comes into contact with the upper surface of the sheet for feeding sheets.

As described earlier, according to the present embodiment, the feed roller 211 is lifted and lowered using the driving force of the lift motor 35, and in the feed-roller separating operation, the lifting of the feed roller 211 (arrow C2) and the lowering of the lift plate 31 (arrow D2) proceed simultaneously, as illustrated in FIG. 7B. Thereby, the feed-roller separating operation is completed speedily.

Now, the feed roller unit 21 is urged downward by the urging force of the pressurizing spring 39, and the feeding position (t) is set to be above the lower position serving as a lower limit of the movable range of the feed roller 211 to ensure an appropriate pressurizing force to the sheet. That is, during the feed-roller contact state, the roller lifting link 37 is at a position corresponding to the lower position of the feed roller 211, while the feed roller unit 21 and the roller lifting lever 25 are pushed up to the feeding position against the urging force of the pressurizing spring 39.

Therefore, if the feed roller 211 is to be separated from the sheet merely by the lifting operation of the feed roller 211, the minimum drive amount for moving the feed roller 211 from the feeding position to the upper position is not sufficient as the drive amount required for driving the lift motor 35. When the lift motor 35 starts to rotate in the reverse direction, the roller lifting link 37 moves upward in a state where the feed roller 211 stays at the feeding position (t). Thereafter, the lift motor 35 rotates further in the reverse direction while the roller lifting link 37 is in contact with the roller lifting lever 25, the roller lifting lever 25 pivots upward for the first time and the feed roller 211 moves upward from the feeding position. Thereby, the drive amount of the lift motor 35 that is required additionally corresponds to the lifting distance from the lower position to the feeding position (t) of the feed roller 211, which is also the amount of excessive lowering of the feed roller 211 from the feeding position (t) to the lower position in other words.

A case has been illustrated where the feed roller 211 is separated from the sheet only by the lifting operation of the feed roller 211, but the same applies to a case where the feed roller 211 is separated from the sheet only by the lowering operation of the lift plate 31 from the feed-roller contact state. Even in this case, additional rotation of the lift motor 35 in the reverse direction becomes necessary, and the drive amount thereof corresponds to the excessive lowering of the feed roller 211.

In contrast, according to the present embodiment, both the feed roller 211 and the lift plate 31 are operated using the driving force of the lift motor 35 during the feed-roller separating operation. Therefore, the feed roller 211 can be separated from the sheet by a smaller drive amount of the lift motor 35 than the configuration where only either the feed roller 211 or the lift plate 31 is moved to separate the feed roller 211 from the sheet. Thereby, the period of time during which operation noise is generated in the driving time of the lift motor 35 can be shortened, and the life of the motor can be elongated by cutting down the drive amount of the lift motor 35.

In a configuration where the feed roller 211 is separated from the sheet by lifting and lowering only the lift plate 31, the pivoting amount of the lift plate 31 is to be ensured to separate the sheet from the feed roller 211 reliably even in a state where the lift plate 31 is fully loaded with sheets. Therefore, it is necessary to increase the size of the cassette 3 to ensure the pivot space of the lift plate 31, or to set a smaller amount as the amount of a full load. In contrast, according to the present embodiment, both the feed roller 211 and the lift plate 31 are lifted and lowered during the feed-roller separating operation, so that the apparatus can be downsized while maintaining the amount of a full load.

The length of the excessive lowering according to the above-described example is set so as to compress the pressurizing spring 39 and ensure the pressurizing force of the feed roller 211. However, the present technique is also applicable to a case where the feeding position is set to a higher position than the lower position so that the feed roller 211 contacts the sheet reliably in a configuration where the pressurizing force of the feed roller 211 is ensured by using the own weight of the feed roller unit 21.

Control Method

Figure 9:
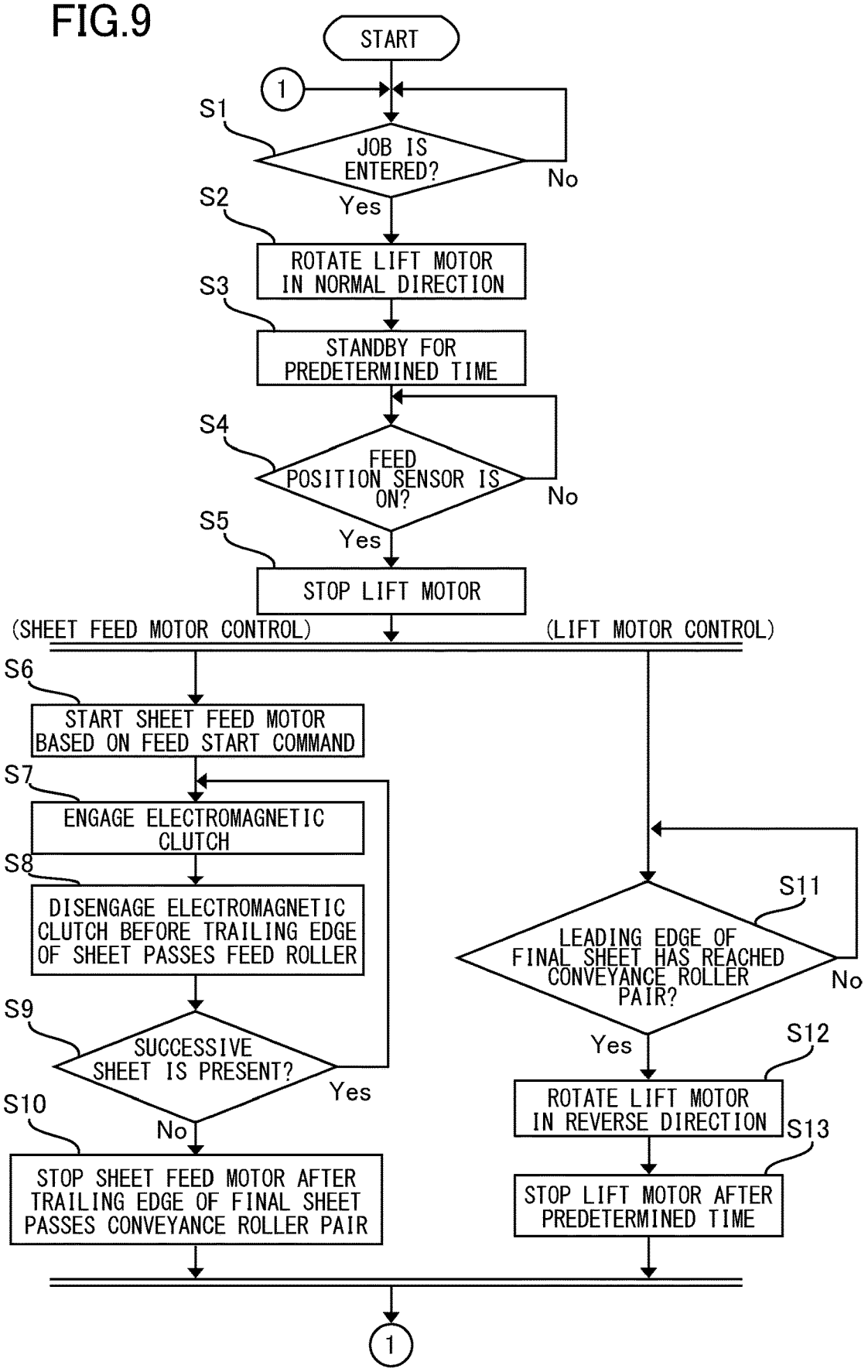
FIG. 9 is a flowchart illustrating a control method of the image forming apparatus according to the first embodiment.

The control method of the sheet feeder 2 according to the present embodiment will be described with reference to FIGS. 8 and 9. FIG. 8 is a block diagram illustrating a control configuration of the image forming apparatus 1 related to the sheet feeder 2, and FIG. 9 is a flowchart illustrating an example of the control method of the sheet feeder 2.

As illustrated in FIG. 8, the control unit 70 serving as a controller is provided on the image forming apparatus 1. The control unit 70 is a control circuit including a central processing unit (CPU 71) serving as an execution unit of programs, a read only memory (ROM 72) serving as a storage unit and a rewritable random access memory (RAM 73). The CPU 71 controls various units of the image forming apparatus 1 including the sheet feeder 2 by reading and executing programs stored in the ROM 72. The ROM 72 stores programs and various setting data required for controlling the image forming apparatus 1, and the RAM 73 serves as a workspace for the CPU 71 executing programs. The ROM 72 and the RAM 73 are examples of a non-transitory storage medium storing control programs for controlling the image forming apparatus 1 according to a specific method.

The CPU 71 operates the sheet feeder 2 by activating the lift motor 35, a sheet feed motor 40 and an electromagnetic clutch 41 while recognizing the current status of the sheet feeder 2 based on the feed position sensor 215 and the cassette open/close sensor 74. The electromagnetic clutch 41 is a clutch that is provided between the sheet feed motor 40 and the feed roller 211 and the conveyance roller 212 that constitute the feed roller unit 21. The electromagnetic clutch 41 couples and cancels, i.e., engages and disengages the drive transmission to the feed roller 211 and the conveyance roller 212 based on ON/OFF of power supply.

The sheet feed motor 40 according to the present embodiment also serves as a driving source of the conveyance roller pair 4 (refer to FIG. 1) that serves as a conveyance member to convey the sheet at a position downstream of the feed roller unit 21. Therefore, the CPU 71 is capable of controlling the feeding of a succeeding sheet using the feed roller unit 21 while continuing conveyance operation of a preceding sheet using the conveyance roller pair 4 by controlling ON and OFF of power to the electromagnetic clutch 41 in a state where the sheet feed motor 40 is rotating.

Now, a control method of the sheet feeder 2 will be described with reference to a flowchart of FIG. 9. Various steps of the present flowchart will be carried out by the CPU 71 of the control unit 70 executing programs. In the following description, whether the conveyance target sheet has passed a predetermined position on the conveyance path is determined based on the result of detection of a sheet by a sensor arranged on the conveyance path or based on the rotation amount of the sheet feed motor 40 from the time these sensors have detected the sheet.

Processing of the flowchart is started in a standby state in which the image forming apparatus 1 is standing by for entry of a print job. In a case where the print job is entered by having image data transmitted from an external computer to the image forming apparatus 1 (S1: Yes), the CPU 71 starts the feed-roller contact operation by rotating a lift motor S2 in a normal direction (S2). By the lift motor 35 rotating in the normal direction, the feed roller 211 starts to be lowered from the upper position and the lift plate 31 starts to be lifted from a standby position. The standby position refers to a position where the lift plate 31 has been lowered by the feed-roller separating operation when a previous job has ended. In S2, after the lift motor 35 has started to rotate in the normal direction, the feed roller 211 passes the feeding position temporarily before reaching the lower position, and the feed position sensor 215 detects the detection portion 213*a*, but at that point of time, the feed-roller contact operation has not been completed. Therefore, the CPU 71 stands by for a predetermined time from the start of rotation of the lift motor 35 in the normal direction, and the rotation of the lift motor 35 in the normal direction is continued regardless of the detection result of the feed position sensor 215 (S3).

After the feed roller 211 reaches the lower position, the upper surface of the sheet supported on the lift plate 31 being lifted comes into contact with the feed roller 211 and the feed roller unit 21 is lifted up against the urging force of the pressurizing spring 39. Then, when the detection portion 213*a* is detected again by the feed position sensor 215 (S4: Yes), the CPU 71 determines that the feed-roller contact operation has been completed and stops the lift motor 35 (S5). Thereby, the sheet feeder 2 becomes the feed-roller contact state. The processes of S1 to S5 described above will also be executed in a case where the CPU 71 detects via the cassette open/close sensor 74 that the cassette 3 in an opened state has been closed.

Now, the contents of control of the sheet feed motor 40 and control of the lift motor 35 being executed in parallel will be described.

Control of Sheet Feed Motor

In a case where a preparation operation in the image forming unit 5 is completed, a feed start command is generated and the sheet feed motor 40 is started (S6). After the sheet feed motor 40 has been started, power is supplied to the electromagnetic clutch 41 and the clutch 41 is engaged, by which the driving force of the sheet feed motor 40 is transmitted to the feed roller 211 and the conveyance roller 212 (S7). By the feed roller 211 rotating in the feed-roller contact state, the uppermost sheet on the lift plate 31 is sent out from the cassette 3 and sheets are fed one at a time in a separated state by the conveyance roller 212 and the separation roller 24.

Before a trailing edge, that is upstream end in the feeding direction, of the sheet being fed passes a contact position with the feed roller 211, power to the electromagnetic clutch 41 is shut off and the clutch 41 will be in a disengaged state (S8). Thereby, the drive of the feed roller unit 21 is stopped, so that the occurrence of a conveyance failure in which the feed roller 211 feeds a succeeding sheet of the sheet being conveyed to cause multiple feeding can be prevented. Further, at the point of time of disengagement of the electromagnetic clutch 41, the leading edge, that is, downstream end in the feeding direction, of the sheet has already reached the conveyance roller pair 4 positioned downstream, so that conveyance is continued by the conveyance roller pair 4 even after disengagement. The sheet being conveyed by the conveyance roller pair 4 passes through the transfer portion and the fixing unit, by which an image is formed to the sheet, before the sheet is discharged by the sheet discharge roller pair.

If the number of printed sheets has not yet reached the number of sheets designated in the print job (S9: Yes), processes of S7 and S8 are repeatedly executed to perform image forming to succeeding sheets. In this case, engaging timing of the electromagnetic clutch 41 is controlled so that the leading edge of the succeeding sheet follows the trailing edge of the preceding sheet at a fixed distance, so-called sheet-to-sheet interval. As described, according to the present embodiment, the electromagnetic clutch 41 is turned on and off repeatedly in a state where the feed-roller contact state is maintained to feed the sheets one at a time. The present configuration is effective in setting a short sheet-to-sheet interval and improving productivity of the image forming apparatus compared to a configuration where the feed roller 211 is lifted and lowered by a cam structure each time a sheet is fed, or compared to a configuration where the sheet feed motor 40 is turned on and off each time a sheet is fed. This is because the response time of the electromagnetic clutch is normally shorter than the time required to lift and lower the feed roller 211 mechanically or the time required to start and stop the sheet feed motor 40.

If the number of printed sheets has become equal to the number of sheets designated by the print job (S9: No), a process to stop the sheet feed motor 40 is performed. In this case, the driving of the sheet feed motor 40 is continued until the trailing edge of the final sheet has passed through the conveyance roller pair 4, and after the sheet has passed through the conveyance roller pair 4, the sheet feed motor 40 is stopped (S10).

Control of Lift Motor

Meanwhile, during feeding of sheets, the CPU 71 maintains the feed-roller contact state, and after the leading edge of the final sheet has reached the conveyance roller pair 4 (S11: Yes), the CPU 71 rotates the lift motor 35 in the reverse direction and starts the feed-roller separating operation (S12). The lift motor 35 is stopped after a predetermined time has elapsed from starting of the rotation in the reverse direction (S13). The predetermined time refers to a time for moving the feed roller 211 to the upper position and moving the lift plate 31 to a position, i.e., standby position, so that the uppermost sheet is positioned lower than the lower position of the feed roller 211. Therefore, the above-described feed-roller contact operation (S2 to S5) is ready for re-execution by rotating the lift motor 35 in the normal direction at a point of time where the lift motor 35 stops after a predetermined time has elapsed. By the lift motor 35 being stopped and the sheet feed motor being stopped at S10, the sheet feeder 2 returns to a standby state where a succeeding job entry can be received.

In a case where the print job requires images to be formed to a plurality of sheets, during a period of time where feeding of sheets is continuously executed (S11: No), the CPU 71 performs control to maintain the height of the uppermost sheet on the lift motor 35 to the feeding position. That is, when the number of sheets on the lift plate 31 is reduced by feeding sheets and the detection signal of the feed position sensor 215 has turned from on to off, an operation is repeatedly performed to rotate the lift motor 35 for a predetermined amount in the normal direction to lift the lift plate 31 up. Thereby, even if the remaining amount of sheets is reduced, the height of the uppermost sheet is maintained at the feeding position, and pressurizing force of the feed roller 211 to the sheet is maintained within an appropriate range.

Now, according to the present embodiment, the control of the lift motor 35, that is, control of the contact and separation of the feed roller, which serves as a driving source for lifting and lowering the feed roller 211 and lifting and lowering the lift plate 31, is performed independently from the control, i.e., conveyance control, of the sheet feed motor 40 serving as a driving source for feeding sheets. Therefore, in a state where the sheet feed motor 40 is still rotating for conveyance of the final sheet as a process for completing the print job, the lift motor 35 can rotate in the reverse direction to start the operation of separating the feed roller 211 from the sheet. In other words, it is possible to start the feed-roller separating operation during execution of conveyance control of the sheet.

Specifically, at a point of time where the leading edge of the final sheet has reached the conveyance roller pair 4 (S11: Yes), the trailing edge of the final sheet is still positioned upstream of the conveyance roller pair 4, so that the driving of the conveyance roller pair 4 by the sheet feed motor 40 is continued. In the present embodiment, the lift motor 35 rotates in the reverse direction in this state to start the feed-roller separating operation. At this time, because the final sheet is already nipped by the conveyance roller pair 4, the conveyance of the final sheet is continued reliably even if the feed roller 211 is separated from the final sheet by the lift motor 35 rotating in the reverse direction.

Thereby, at least a portion of a period of execution of the feed-roller separating operation overlaps with a period during which the final sheet is conveyed by the conveyance roller pair 4 and conveyance mechanisms arranged downstream thereof, such as the transfer portion, the fixing unit and the sheet discharge roller pair. That is, at least a portion of the period during which driving noise of the lift motor 35 is generated for separating the feed roller 211 from the sheet falls within the period during which operation noise of conveying the sheet in the image forming apparatus is generated, so that the period during which the image forming apparatus generates noise can be shortened.

Further, if the contents of jobs are the same, the required time from the entry of a job to the returning of the sheet feeder 2 to the standby state is shortened compared to a configuration where the feed roller 211 is lifted to the upper position by rotating the sheet feed motor 40 in the reverse direction after the final sheet has been fed. In addition, according to the present embodiment, since the present embodiment does not adopt a configuration to lift and lower the feed roller 211 by rotating the sheet feed motor 40 in the reverse direction, drive of the sheet feed motor 40 rotating in the reverse direction can be used for other control purposes.

Modified Example

According further to the present embodiment, a configuration is adopted where the feed roller unit 21 is detachably attached to the feeding frame 22, but a configuration can also be adopted where the feed roller unit 21 is not attached in a detachable manner. For example, a configuration can be adopted where the roller holder 213 is formed integrally with the roller lifting lever 25, in which the feed roller 211 and the conveyance roller 212 can be independently detachably attached to the integrated structure.

Second Embodiment

Next, a second embodiment will be described with reference to FIGS. 10 to 12. According to the present embodiment, a configuration of the roller lifting portion 30B differs from the first embodiment. Elements having substantially the same configurations and functions as the first embodiment are denoted with the same reference numbers as in the first embodiment, and descriptions thereof are omitted.

Figure 10:
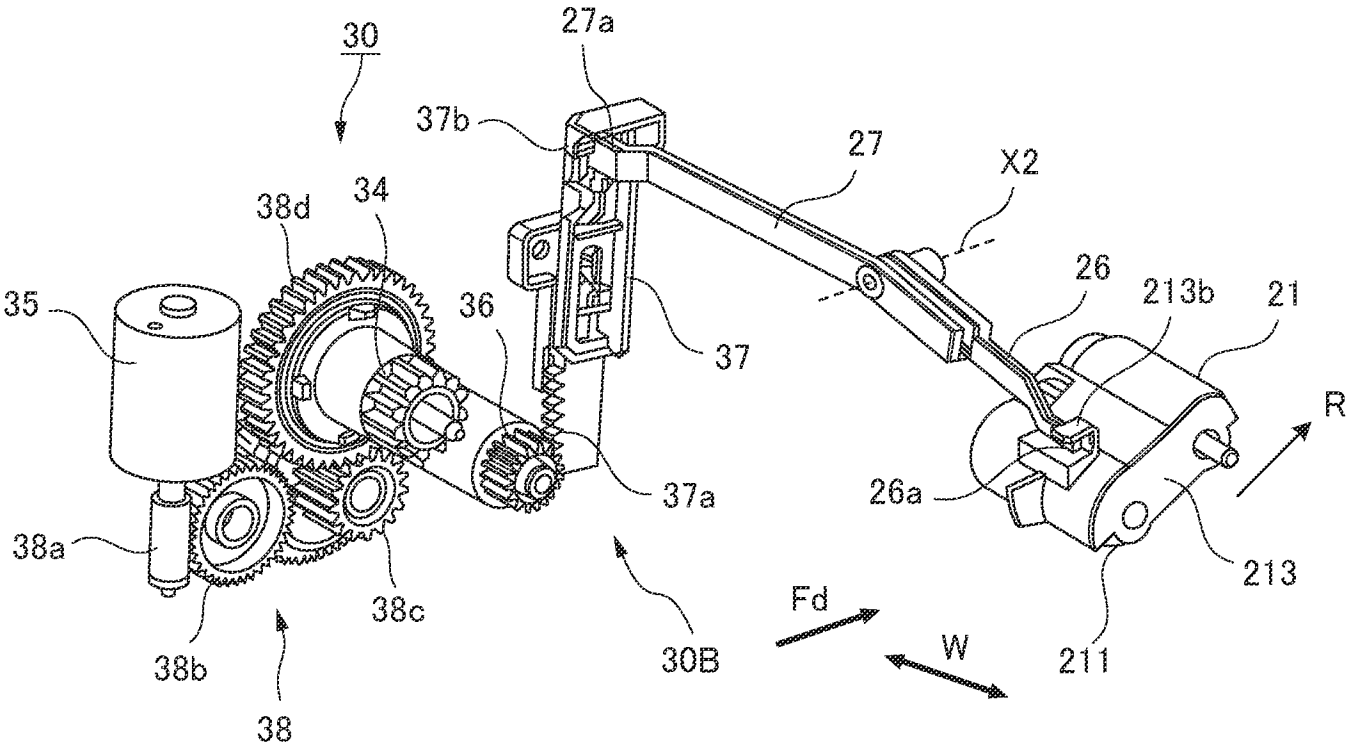
FIG. 10 is a perspective view illustrating a lifting mechanism of a feed roller according to a second embodiment.

FIG. 10 is a perspective view illustrating a configuration of the roller lifting portion 30B according to the present embodiment. Similar to the first embodiment, the roller lifting portion 30B is a device, serving as a feed roller contact-separation portion, that moves the feed roller 211 to be in contact with and separated from the sheet by swinging the roller holder 213 using the driving force of the lift motor 35.

The roller lifting portion 30B according to the present embodiment adopts a configuration that includes a roller-coupled lever 26 and a link-coupled lever 27 instead of the roller lifting lever 25 according to the first embodiment. That is, the roller lifting portion 30B is composed of the roller lifting gear 36, the roller lifting link 37, the roller-coupled lever 26 and the link-coupled lever 27. The configuration of the roller lifting gear 36 and the roller lifting link 37 is similar to the first embodiment, wherein the roller lifting link 37 is moved by sliding motion upward and downward by the driving force being transmitted via the roller lifting gear 36 when the lift motor 35 rotates in the normal and reverse directions.

However, unlike the first embodiment, the roller lifting link 37 is designed to slide upward when the lift motor 35 rotates in the normal direction and to slide downward when the lift motor 35 rotates in the reverse direction. Such configuration can be realized, for example, by providing an idler gear between the roller lifting gear 36 according to the present embodiment and a gear of the reduction gear train 38 that is meshed with the roller lifting gear 36 according to the first embodiment.

The roller-coupled lever 26 and the link-coupled lever 27 are both supported swingably with respect to the feeding frame 22 and mutually connected to swing in linkage with each other. In the present embodiment, the roller-coupled lever 26 and the link-coupled lever 27 swing about a swing axis X2 serving as a common axis. The swing axis X2 is an axis parallel to the feeding direction Fd viewed in the vertical direction, i.e., axis perpendicular to the rotational axis direction of the feed roller 211. The roller-coupled lever 26 has an end portion 26*a* engaged with the roller holder 213 of the feed roller unit 21, and the roller-coupled lever 26 swings in linkage with the feed roller unit 21. The link-coupled lever 27 has an end portion 27*a* opposed to the roller lifting link 37, and the link-coupled lever 27 swings in linkage with the roller lifting link 37. Further, the roller-coupled lever 26 and the link-coupled lever 27 can be configured as an integrated member by being mutually fixed to each other, or can be configured so that the levers are coupled to enable relative movement via a spring member.

The feed roller unit 21 can be attached detachably to the feeding frame 22, and an engagement portion, i.e., connecting portion, of the feed roller unit 21 and the roller-coupled lever 26 can also be attached detachably. Of course, the engagement portion is configured so that the end portion 26*a* of the roller-coupled lever 26 fits to the hook portion 213*b* provided on the roller holder 213.

The feed roller unit 21 is removable from the feeding frame 22 toward a direction R intersecting a rotational axis of the feed roller 211. In correspondence therewith, the hook portion 213*b* is formed to have a recessed shape where an upstream side in a removal direction R is opened, and along with the operation to remove the feed roller unit 21, the end portion 26*a* of the roller-coupled lever 26 is disengaged from the hook portion 213*b*. In a case where the feed roller unit 21 is attached to the feeding frame 22 toward a direction opposite to the removal direction R, the end portion 26*a* of the roller-coupled lever 26 is fit to the hook portion 213*b*, and the roller-coupled lever 26 and the roller holder 213 are in a state swingable in linkage with each other.

Figure 11A:
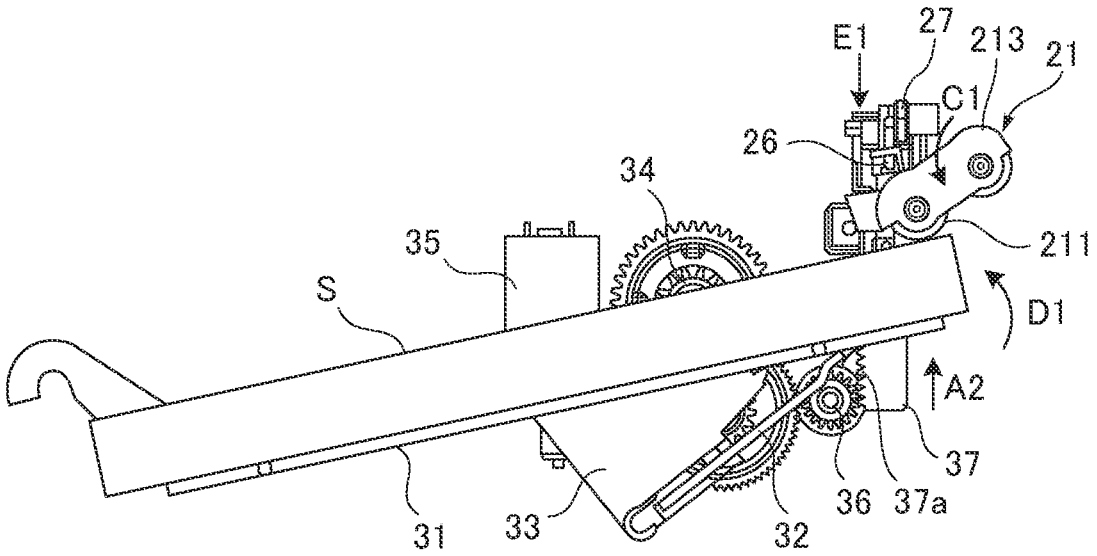
FIG. 11A is a view illustrating a lifting and lowering operation of the feed roller and a lift plate according to the second embodiment.
Figure 11B:
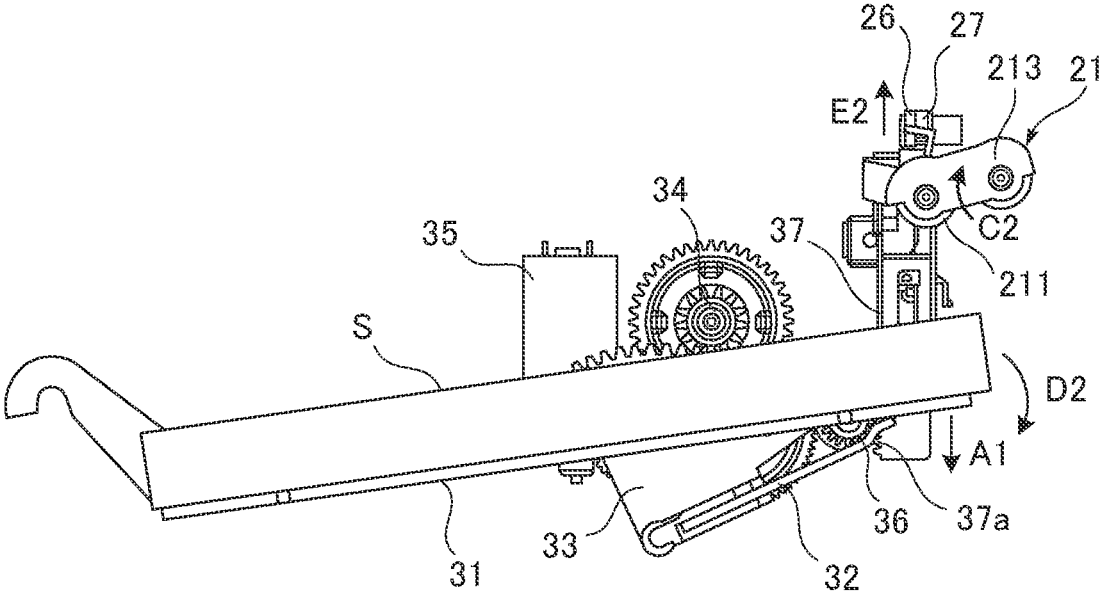
FIG. 11B is a view illustrating the lifting and lowering operation of the feed roller and the lift plate according to the second embodiment.
Figure 12A:
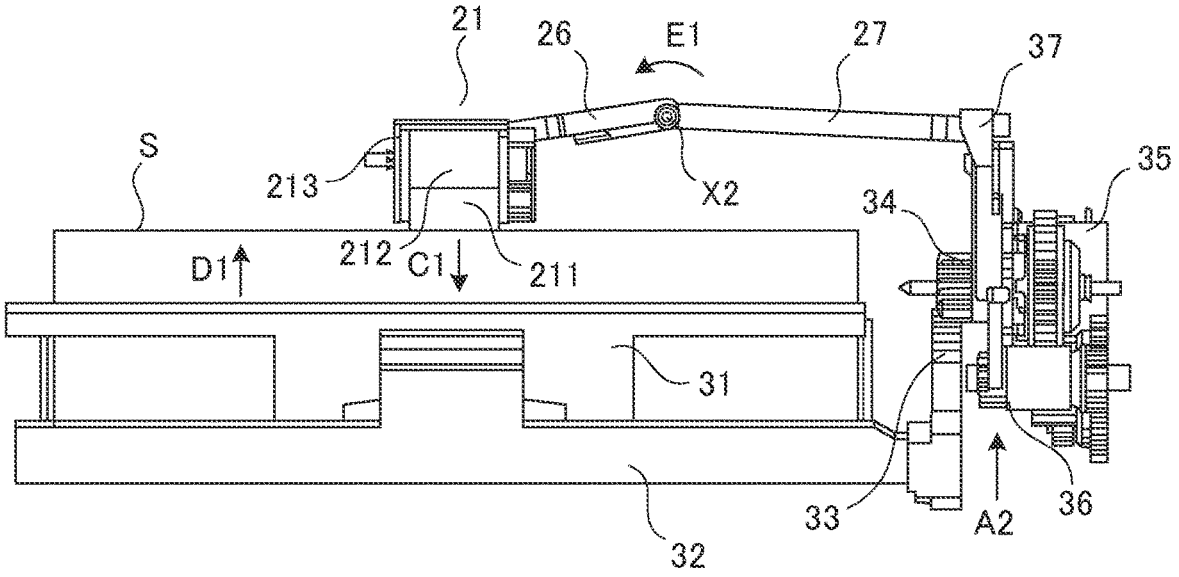
FIG. 12A is a view illustrating the lifting and lowering operation of the feed roller and the lift plate according to the second embodiment.

Next, the lifting and lowering operation of the lift plate 31 and the feed roller 211 by the lifting mechanism 30 according to the present embodiment will be described with reference to FIGS. 11A to 12B. FIG. 11A is a schematic drawing illustrating a feed-roller contact state viewed in a rotational axis direction of the feed roller 211, that is, a width direction of the sheet. FIG. 11B is a schematic drawing illustrating a feed-roller separated state viewed in the rotational axis direction of the feed roller 211. FIG. 12A is a schematic drawing illustrating a feed-roller contact state viewed from the downstream side of the feeding direction, and FIG. 12B is a schematic drawing illustrating a feed-roller separated state viewed from the downstream side of the feeding direction.

As illustrated in FIGS. 11A and 12A, the lift motor 35 rotates in the normal direction in the feed-roller contact operation. Thereby, the lifting mechanism 30 performs operation to lower the feed roller 211 by the roller lifting portion 30B and lift the lift plate 31 by the lift plate lifting portion 30A. That is, the roller lifting link 37 lifts by rotation of the lift motor 35 in the normal direction (arrow A2), and along therewith, the roller-coupled lever 26 and the link-coupled lever 27 swing in a first swinging direction (arrow E1). Further, the feed roller unit 21 pivots downward in linkage with the roller-coupled lever 26 (arrow C1). In parallel therewith, the lift member 32 pivots upward by the rotation of the lift motor 35 in the normal direction and lifts the lift plate 31 up (arrow D1). As described earlier, the lifting of the lift plate 31 is stopped by the feed position sensor 215 detecting the detection portion 213*a* of the roller holder 213, and the feed-roller contact state is realized.

Figure 12B:
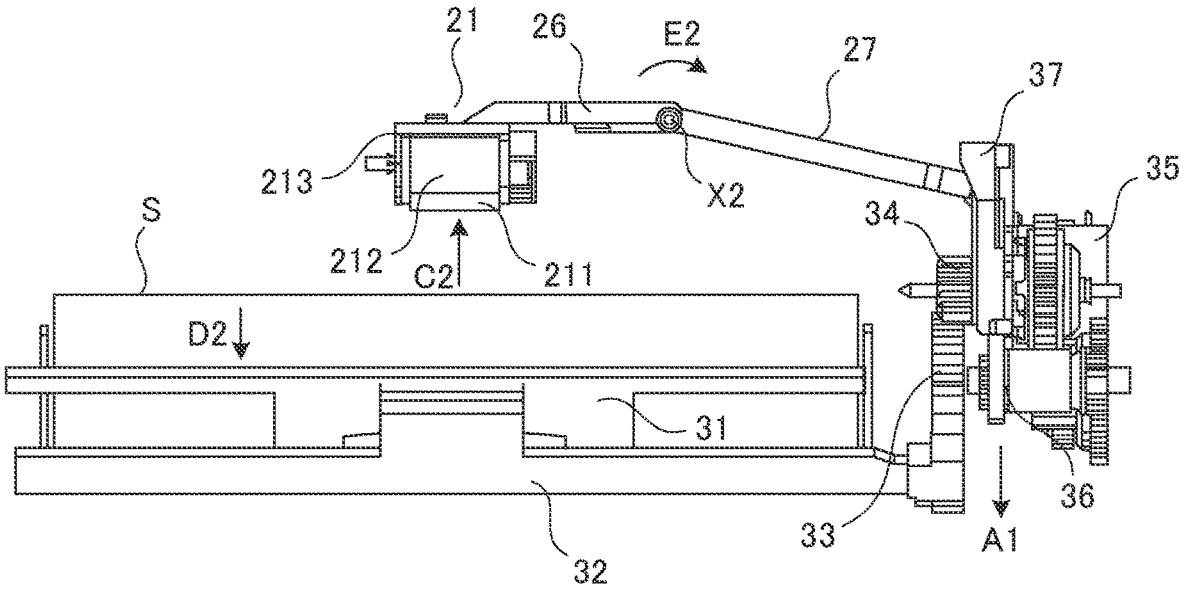
FIG. 12B is a view illustrating the lifting and lowering operation of the feed roller and the lift plate according to the second embodiment.

Meanwhile, as illustrated in FIGS. 11B and 12B, the lift motor 35 rotates in the reverse direction during the feed-roller separating operation. Thereby, the lifting mechanism 30 performs an operation to lift the feed roller 211 by the roller lifting portion 30B and lower the lift plate 31 by the lift plate lifting portion 30A. That is, the roller lifting link 37 lowers by rotation of the lift motor 35 in the reverse direction (arrow A1), and along therewith, the roller-coupled lever 26 and the link-coupled lever 27 swing in a second swinging direction (arrow E2). The feed roller unit 21 pivots upward in linkage with the roller-coupled lever 26 (arrow C2). In parallel therewith, the lift member 32 pivots downward by rotation of the lift motor 35 in the reverse direction, lowering the lift plate 31 (arrow D2). Thereby, the feed-roller separated state is realized.

As described, according to the present embodiment, even though a portion of the configuration of the roller lifting portion 30B differs from the first embodiment, the driving force of the lift motor 35 is used during the feed-roller separating operation to operate both the feed roller 211 and the lift plate 31, similar to the first embodiment. Therefore, similar to the first embodiment, the feed-roller separating operation is performed speedily to shorten the period of time during which operation noise is generated in the driving time of the lift motor 35 and cut down the drive amount of the lift motor 35 to thereby elongate the life of the motor. Since the feed-roller separating operation is performed by lifting and lowering both the feed roller 211 and the lift plate 31, the apparatus can be downsized while maintaining the same amount of full load.

Further, the operation of the sheet feeder 2 according to the present embodiment is controlled by a control method similar to the one described in the first embodiment. Therefore, similar to the first embodiment, it may be possible to shorten the period of time during which the image forming apparatus generates noise. Further, the time required from the entry of a job to the returning of the sheet feeder 2 to the standby state is shortened, and an advantage is realized in that the rotation of the sheet feed motor 40 in the reverse direction can be used for other control purposes.

Even further, similar to the first embodiment, the feed roller unit 21 according to the present embodiment may adopt a configuration where it is not detachably attached to the feeding frame 22.

OTHER EMBODIMENTS

The first and second embodiments described above have been described based on the sheet feeder 2 serving as a sheet feeding apparatus assembled to the image forming apparatus. However, the present technique is not limited to such example, and it can also be applied to a sheet feeding apparatus that is disposed independently from the image forming apparatus. For example, the present technique is adoptable to a sheet feeding apparatus that is coupled to an image forming apparatus to constitute an image forming system together with the image forming apparatus, that feeds sheets serving as recording material to the image forming apparatus.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-154160, filed on Aug. 26, 2019, which is hereby incorporated by reference herein in its entirety.

What is claimed is:

1. A sheet feeding apparatus comprising:

a sheet support configured to support a sheet;

a sheet feeder configured to contact an upper surface of the sheet supported on the sheet support and feed the sheet;

a feed position sensor configured to output a detection signal that changes according to whether the sheet feeder is at a predetermined feeding position;

a spring configured to urge the sheet feeder downward;

a conveyor configured to convey the sheet fed from the sheet feeder;

a first motor configured to drive the sheet feeder and the conveyor;

a second motor configured to rotate in a first direction and in a second direction opposite to the first direction;

a lift connected to the second motor and configured to lift the sheet feeder in a case where the second motor rotates in the second direction; and a controller configured to control the first motor and the second motor, wherein during a job of feeding a sheet from the sheet support, the controller is configured to start rotation of the second motor in the second direction after starting feeding of a final sheet in the job and before stopping the first motor, wherein the lift is configured to lift and lower the sheet feeder to an upper position above the feeding position and a lower position below the feeding position, and wherein in a case where the second motor rotates in the first direction, after the sheet feeder has moved from the upper position to the lower position, the lift allows the sheet feeder to be pressed by the sheet supported on the sheet support and moved from the lower position to the feeding position against an urging force of the spring.

2. The sheet feeding apparatus according to claim 1, wherein the controller is configured to start the rotation of the second motor in the second direction after a leading edge of the final sheet in a feeding direction has reached the conveyor and before a trailing edge of the final sheet passes the conveyor, and thereafter, stop the first motor after the trailing edge of the final sheet has passed the conveyor.

3. The sheet feeding apparatus according to claim 2, further comprising a clutch configured to engage and disengage drive transmission from the first motor to the sheet feeder, wherein the controller is configured to repeatedly execute an operation of engaging the clutch and thereafter disengaging the clutch so that sheets are fed from the sheet support one sheet at a time, the operation being executed in a state where the sheet feeder is maintained in contact with an upper surface of an uppermost sheet of the sheets supported on the sheet support by the second motor and where driving of the conveyor by the first motor is continued.

4. The sheet feeding apparatus according to claim 1, wherein the lift includes a swing supported swingably on a frame of the sheet feeding apparatus, coupled to the sheet feeder, and configured to swing to lift and lower the sheet feeder, and wherein the sheet feeder is removable in a predetermined removing direction with respect to the frame and is configured to be disengaged from the swing along with a removal operation of removing the sheet feeder in the removing direction and to be engaged with the swing along with an operation of attaching the sheet feeder in an opposite direction to the removing direction.

5. The sheet feeding apparatus according to claim 1, wherein the lift includes a first lift configured to lift and lower the sheet support, a second lift configured to lift and lower the sheet feeder, and a transmission to transmit driving force of the second motor to the first lift and the second lift, wherein the second lift includes a swing supported swingably on a frame of the sheet feeding apparatus, coupled to the sheet feeder and configured to swing to lift and lower the sheet feeder, and a link supported slidably by the frame and configured to couple the transmission and the swing, and wherein the link is configured to convert rotation transmitted from the second motor via the transmission to linear motion by which the link causes the swing to swing.

6. The sheet feeding apparatus according to claim 5, wherein the swing is configured to swing about an axis that extends in a width direction of a sheet perpendicular to a feeding direction of the sheet by the sheet feeder.

7. The sheet feeding apparatus according to claim 5, wherein the swing is configured to swing about an axis that extends in a direction parallel to a feeding direction of the sheet by the sheet feeder when viewed in a vertical direction.

8. The sheet feeding apparatus according to claim 1, wherein the lift includes a link configured to move in linkage with lifting and lowering of the sheet feeder, and a one-way gear configured to mesh with the link, wherein in a case where the second motor rotates in the first direction, the link moves in a movement direction for lowering the sheet feeder such that the link follows rotation of the one-way gear by an action of urging force of the spring, and wherein in a case where the second motor rotates in the second direction, the one-way gear becomes a locked state, and the link is moved in a movement direction for lifting the sheet feeder by receiving driving force of the second motor transmitted via the one-way gear.

9. The sheet feeding apparatus according to claim 1, wherein the lift includes a first lift configured to lift and lower the sheet support, a second lift configured to lift and lower the sheet feeder, and a reduction gear train that includes a worm gear and is configured to increase a torque received from the second motor and transmit the torque to the first lift and the second lift.

10. An image forming apparatus comprising:

the sheet feeding apparatus according to claim 1; and an image former configured to form an image on a sheet fed from the sheet feeding apparatus.

* * * * *